United States Patent [19]

Torokvei

[11] 4,342,388

[45] Aug. 3, 1982

[54] STACKABLE BOTTLE CARRIER

[75] Inventor: Thomas E. Torokvei, Don Mills, Canada

[73] Assignee: Scepter Manufacturing Co., Ltd., Toronto, Canada

[21] Appl. No.: 73,234

[22] Filed: Sep. 7, 1979

[51] Int. Cl.[3] ..... B65D 75/00; B65D 21/00; B65D 85/62

[52] U.S. Cl. ..... 206/203; 206/510

[58] Field of Search ..... 206/203, 140, 144, 201, 206/202, 163, 164, 165, 166, 170–174, 510

[56] References Cited

U.S. PATENT DOCUMENTS

| | | | |
|---|---|---|---|
| 2,377,520 | 6/1945 | Robinson, Jr. et al. . | |
| 2,395,601 | 2/1946 | Wenthe | 206/174 |
| 2,416,999 | 3/1947 | Keith et al. . | |
| 2,983,406 | 5/1961 | Arneson . | |
| 3,055,542 | 9/1962 | Russo . | |
| 3,055,543 | 9/1962 | Russo . | |
| 3,991,879 | 11/1976 | Hiroto . | |
| 4,040,517 | 8/1977 | Torokvei | 206/510 |
| 4,071,162 | 1/1978 | Steinlein et al. | 206/203 |
| 4,204,596 | 5/1980 | Davis | 206/203 |
| 4,234,114 | 11/1980 | Wood | 206/510 |

*Primary Examiner*—Joseph Man-Fu Moy
*Attorney, Agent, or Firm*—Blakely, Sokoloff, Taylor & Zafman

[57] ABSTRACT

A carrier for carrying a plurality of bottles, the carrier having a stacking capability when filled with bottles and an improved stacking capability when empty. Each carrier is comprised of two body members. The upper body member comprises side and end walls connected in generally rectangular shape, a central dividing member having an extension thereof forming a handle, and upper partition walls cooperating with the central dividing member to form cells for holding bottles. The lower body member comprises a bottom with side and end walls and lower partition walls extending upwardly therefrom. The upper body member is slidably attached over the lower body member to form the carrier, with the two body members interfitting for limited motion therebetween. The carrier is in its extended position when it is carried filled with bottles; the carrier effectively having end and side walls of a length substantially equal to the vertical dimensions of the walls of the upper body member plus the walls of the lower body member for providing protection and lateral support for the bottles contained therein. When the carrier is empty, the upper body member is pushed down over the lower body member. In this contracted position many more carriers can be stacked as bottle carriers of normal dimensions. Registration for stacking of empty carriers is provided by reception of the handles of each carrier in a recessed open area in the bottom of the next carrier above in the stack. The carrier bottom, partition walls and central dividing member are relieved to form a slotted region for receiving the handle of the empty carton below.

27 Claims, 19 Drawing Figures

Fig. 16
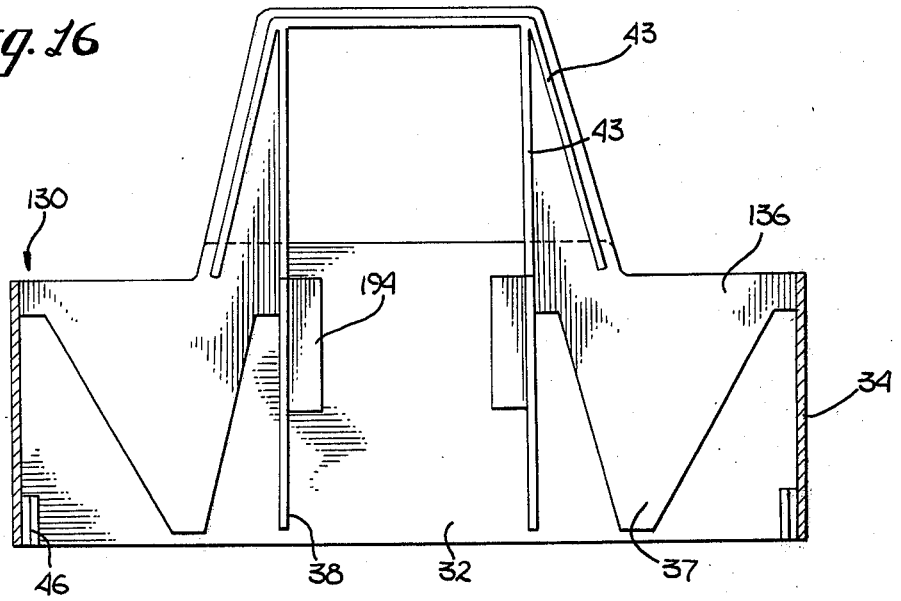
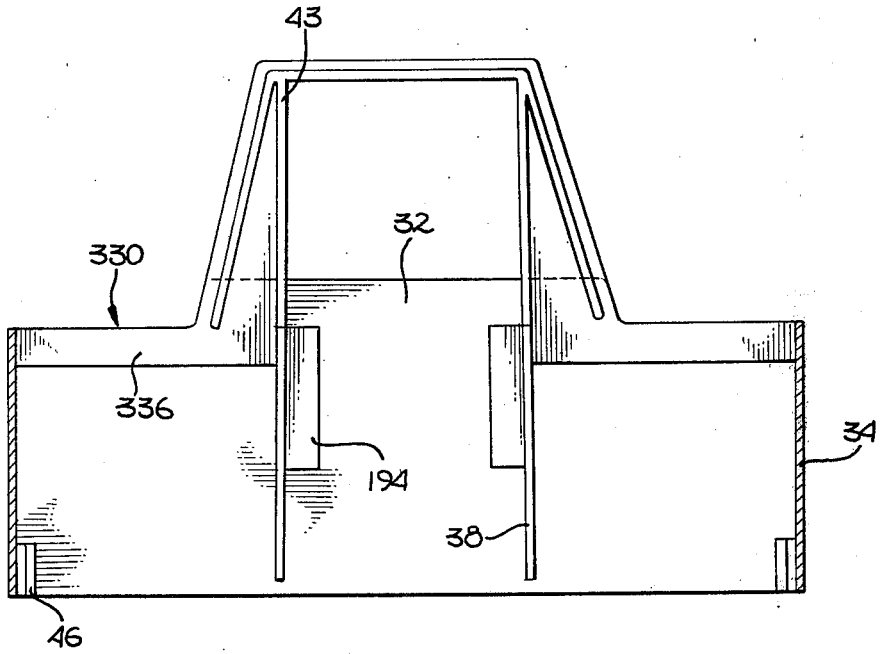
Fig. 19

STACKABLE BOTTLE CARRIER

BACKGROUND OF THE INVENTION

1. Field of the Invention

This invention relates to the field of bottle carriers, and more specifically reuseable carriers for soft drink bottles and the like.

2. Prior Art

It has been the goal of manufacturers of bottle carriers to make carriers for beverage bottles which are simply constructed, strong, able to withstand hard usage and easily and safely cleaned. The carriers should also provide protection for the bottles contained therein against impact. Another goal, which has been difficult to attain in conjunction with those discussed above, is to provide a carrier which may be economically transported while empty from the carrier manufacturer to the bottling plant in the first instance, and from distribution centers back to the bottling plant thereafter. The weight of the carriers and the space occupied by them are the important factors in this regard.

The prior art known is as follows: U.S. Pat. No. 2,377,520 issued to Joseph Robinson, Jr. and Mark L. Seibert; U.S. Pat. No. 2,416,999 issued to Claude D. Keith and Joseph F. O'Brien; U.S. Pat. No. 2,983,406 issued to Edwin L. Arneson; U.S. Pat. No. 3,991,879 issued to Kashichi Hirota; and U.S. Pat. No. 4,040,517 issued to the present invention.

Robinson, Jr. et al. disclose a bottle carrier which is constructed from a multiplicity of pieces, with some pieces made of one material, metal, and others made of another material, Masonite board. Therefore, this carrier is difficult and expensive to manufacture. This carrier is provided with a slidably mounted handle member. With the carrier filled with bottles, the handle member can be extended past the bottle tops for carrying the carrier by hand. The handle can be collapsed to a point below the bottle tops to allow filled bottle carriers to be stacked one upon the other. However, no provision is made for stacking empty carriers, and indeed, such stacking is impossible. Because of the weight of the carriers and the volume of space they occupy, they are impracticably expensive to transport.

Keith et al. disclose a bottle carrier which similarly has a slidably mounted central partition. An upward movement permits the upper edge of the partition to serve as a handle for the carrier. The partition is provided with a handle portion and handle aperture which are readily accessible in the raised position of the partition to permit engagement by the user in carrying the carrier. A lowering movement enables the top of the partition to be lowered below the tops of the bottles so as to enable stacking of the carriers on top of each other when the same are filled with bottles. However, just as in the carrier disclosed by Robinson, Jr. et al., stacking of the carriers while they are empty is precluded, thereby making the shipment of carriers from the manufacturer to the bottling company very costly.

Arneson discloses a three piece bottle carrier formed of flexible paperboard. Because this carrier is made from paperboard, it is not susceptible to being easily cleaned and sterilized. Paperboard carriers are not very durable, particularly if they get wet, and are therefore incapable of rendering extensive use and reuse. The carrier disclosed by Arneson is in fact intended for single use. The Arneson carrier is to be shipped from the manufacturer to the bottling plant in disassembled form, in flat or folded position, to achieve economy of space. While the Arneson carrier may achieve such economy of space during shipment to the bottling plant from the manufacturer, such economy is offset by the time consumed in the complicated task of properly folding and assembling the multiple pieces of the carriers when they arrive at the bottling plant. And, like the Robinson, Jr. et al. and Keith et al. carriers, the carrier disclosed by Arneson has a slidable handle panel adapted to avoid interference with the stacking of filled carriers, but which prevents the stacking of empty carriers.

Hirota discloses a one piece, fixed body, molded plastic bottle carrier having separated compartments for receiving bottles. Such carriers are readily stacked one on the other when they are empty. The carrier disclosed by Hirota, however, provides little, if any, protection for the bottles contained therein against impact.

The carrier described in U.S. Pat. No. 4,040,517, issued to the inventor of the present invention, is capable of being manufactured in one piece of molded plastic. It comprises side and end walls, a central dividing member with handle means extending upwards of it, partition means which cooperate with the central dividing member to define bottle receiving cells, and a bottom support member. The bottom support member has an opening and the central dividing member and partition means have recesses for receiving the handle means of a similar empty carrier when in stacked relationship. When filled, the carrier disclosed is also stackable with other similar filled carriers. Thus, the carrier is strong, durable and capable of extensive reuse. It is stackable whether empty or full, with registration of stacked empty carriers to prevent their shifting provided by the handle members fitting within the opening and recesses of carriers above. The side and end walls of this carrier provide protection to the bottles contained therein where they are most susceptible to impact. The capacity to be registrably stacked while empty provides for great economies of space and handling in transporting the carrier from the manufacturer to the bottling plant and from distribution centers back to the bottling plant thereafter.

SUMMARY OF THE INVENTION

It is an object of this invention to provide a bottle carrier which is strong, able to withstand hard and repeated use, capable of being easily and safely sterilized, and which provides for the bottles contained therein protection against impact.

It is a further object of this invention to provide a bottle carrier which occupies less vertical space when empty.

It is a further object of this invention to provide a bottle carrier which is capable of being stacked with a plurality of similar carriers in a greater stacking density than heretofore achieved so that the costs for transporting and storing each case is reduced.

It is a further object of this invention to provide a two piece bottle carrier which is easily assembled.

It is a further object of this invention to provide a bottle carrier which may be molded of plastic.

These and other objects of the present invention will become apparent from the following disclosure and the accompanying drawings.

The present invention provides a two piece bottle carrier. The upper body member is comprised of a pair of oppositely disposed end walls connected to a pair of oppositely disposed side walls to form a generally rectangular shape, a central dividing member with handle means extending upwards therefrom, and upper partition walls cooperating with the central dividing member to form cells for holding bottles. This upper member is slidably attached to a lower member. The lower member has a bottom for supporting the bottles to be contained in the carrier and side and end panels and lower partition panels which cooperate to further define the cells for holding bottles. The bottom has an elongated opening at its center and the central dividing member and both sets of partitions are recessed to receive the handle of a carrier positioned below when the carriers are in stacked relation. When a bottle carrier containing one or more bottles is held by the handle means, the top body member rides up high on the bottom body member so that the carrier is in an extended position. In this extended position the carrier provides the proper bottom and side support for the bottles. When the carrier is empty, it can be telescoped into a contracted position; that is, the upper body member can be pushed down over the bottom member so that the carrier occupies no more vertical space than the taller of the upper body member walls and lower body member panels. Thus, the carrier of the present invention has a much greater stacking capacity than prior art carriers, and still provides strength, durability, cleanliness, and protection against impact.

These properties and other advantages of the present invention will become apparent from the following description and accompanying drawings.

BRIEF DESCRIPTION OF THE DRAWINGS

FIG. 16 is a cross sectional side view of another embodiment of the upper body member of the bottle carrier of the present invention.

FIG. 19 is a cross sectional side view of still another embodiment of the upper body member of the present invention.

DETAILED DESCRIPTION OF THE INVENTION

Figure 1:
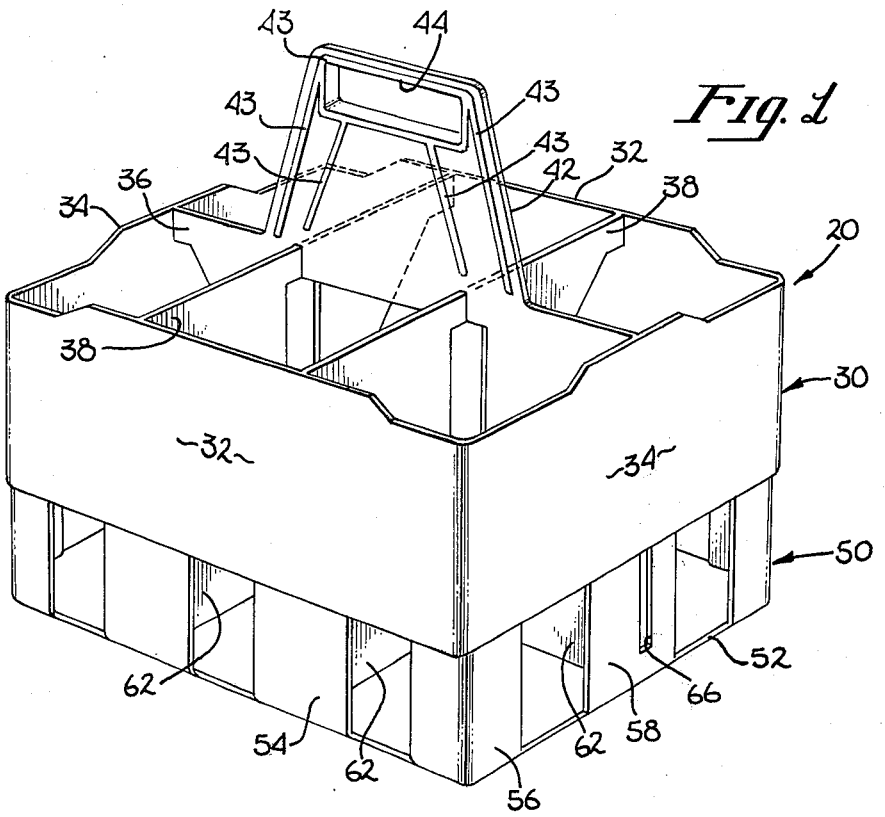
FIG. 1 is a perspective view of a preferred embodiment of the new bottle carrier in the extended position.

In the detailed description of the new bottle carrier which follows, identical numerical designations will be used throughout the drawings to indicate similar elements.

FIGS. 1 through 15 illustrate a preferred embodiment of the present invention, generally designated by the numeral 20. The new bottle carrier is comprised of two pieces, an upper body member 30 and a lower body member 50. As can be seen in FIGS. 3, 10, 11 and 14, the upper body member is rectilinear in plan view, having side walls 32 and end walls 34. Running parallel to the side walls and extending from one end wall to the other is central dividing member 36, which is oriented to conform generally to a vertical plane in the upright attitude of the carrier. Extending from the central dividing member to the side walls are partition walls 38, which in conjunction with the central dividing member and the side and end walls form a rectilinear grid of approximately square cells for receiving bottles. Extending upwardly from central dividing member 36 is handle forming member 42, which defines manual grasping aperture 44. A tab 46 extends inwardly from the bottom of each of the end walls. As can be seen in FIG. 3, tabs 46 are displaced slightly from the vertical center line of the end walls. In viewing each end wall from the interior of the carrier, tabs 46 are both displaced the same distance and in the same direction relative to such center line.

The lower body member illustrated in FIGS. 4, 12, 13 and 15 is also rectilinear in plan view. It comprises a bottom panel 52. Upstanding from this bottom panel are side panels 54, corner panels 56 and end panels 58. Extending upwardly from the bottom panel and inwardly from the side and end panels are partition panels 62. Together with the side, end and corner panels, the lower partition panels form a rectilinear grid of approximately square cells for receiving bottles. End panels 58 have slots 66 disposed within them. These slots run almost the entire height of the end walls and similarly to the tabs of the upper body member are displaced slightly from the vertical center line of the end panels. In viewing each end panel from the interior of the carrier, slots 66 are both disposed the same distance and the same direction from such center line.

Each of the upper body member and the lower body member, including the elements previously described and those about to be described, is designed to be molded from plastic in a single or "one-shot" molding operation. A number of plastics are well-known to those skilled in the art to be suitable for this purpose. However, it is preferred to use high-density polyethylene for this purpose.

Figure 9:
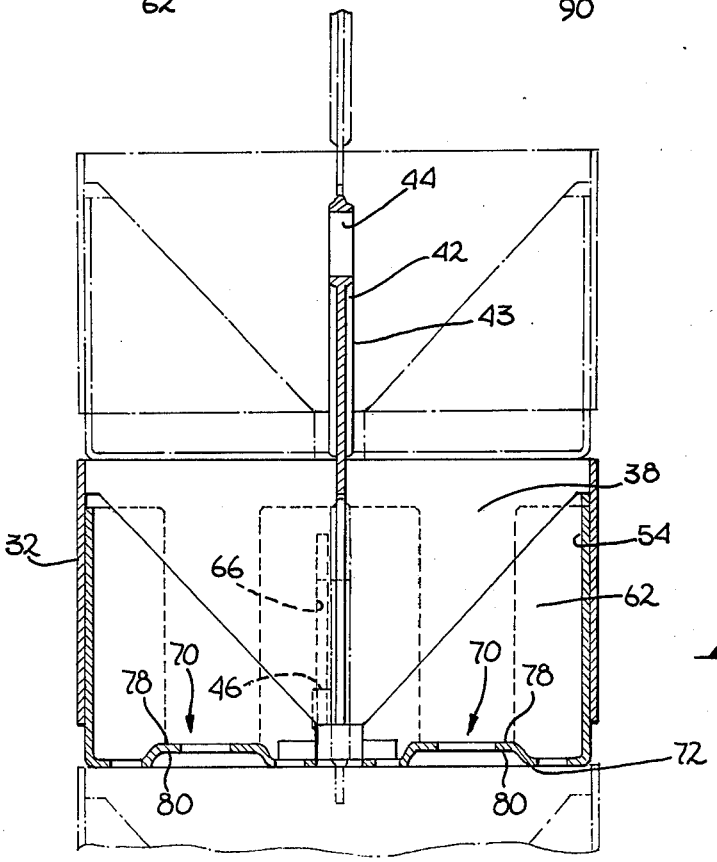
Figure 10:
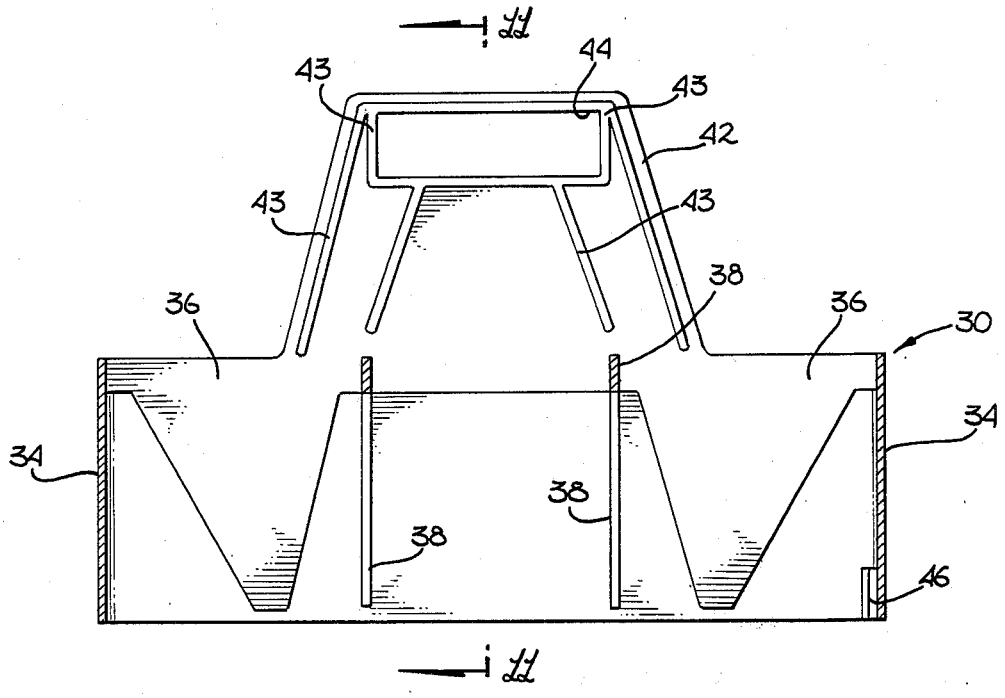
FIG. 10 is a cross-sectional side view of the upper body member of the new bottle carrier as shown in FIG. 1.

Referring to FIGS. 1, 9 and 10, handle forming means 42 extending upwards from central dividing member 36 is thin in the horizontal direction when seen in end view. Such a sheet-like member may not possess the rigidity preferred for a handle forming means. Ribs 43 extend out from the handle forming means on a direction which is normal to the plane of the handle forming means. These ribs also surround the handle grasping aperture 44 and impart to the handle forming means the requisite rigidity.

The carrier of the present invention is assembled by placing the upper body member vertically above the lower body member. The upper body member is then pushed down over the lower body member with the side and end walls of the upper body member peripherally surrounding the upstanding side, corner and end panels of the lower body member. (See FIG. 3.) The central dividing member 36 and partition walls 38 are positioned so that they align vertically with partition panels 62 of the lower body member thus forming a single rectilinear grid of bottle receiving cells. Similarly, tabs 46 and slots 66 have corresponding alignment. The tabs are inserted into their respective slots, completing the assembly of the new bottle carrier.

Figure 14:
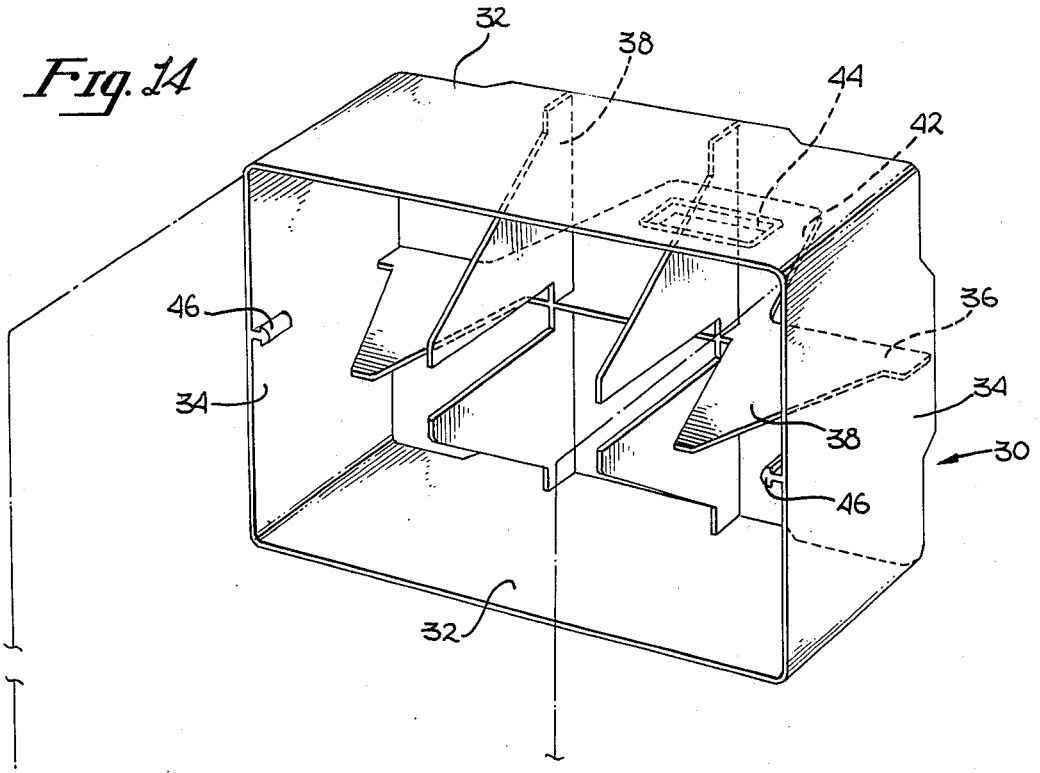
FIG. 14 is a bottom perspective view of the upper body member of the new bottle carrier shown in FIG. 1.

As shown in FIGS. 3 and 14, tabs 46 have the cross-sectional appearance of a mushroom with the head of each tab being wider across than the width of slot 66. The tabs are, therefore, easily inserted through the slots and yet resist becoming dislodged therefrom during the use of the bottle carrier. The diagonal disposition of the tabs and slots about the line formed by the central dividing member and the partition panels which extend inwardly from end panels 58 provides for fool proof assembly of the new carrier. Regardless of which way the upper and lower body members are rotated relative to each other, tabs 46 and slots 66 will always align with each other for insertion of the tabs into the slots.

Figure 5:
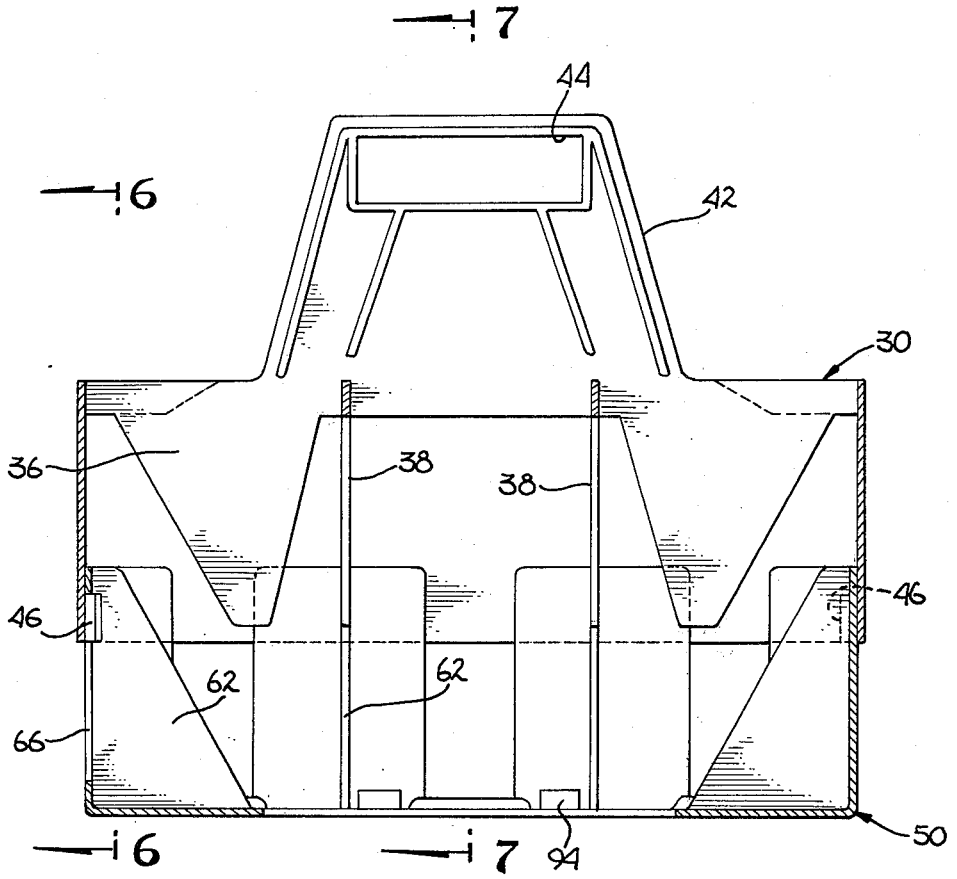
FIG. 5 is a cross-sectional view of the new bottle carrier taken along line 5—5 of FIG. 3.
Figure 6:
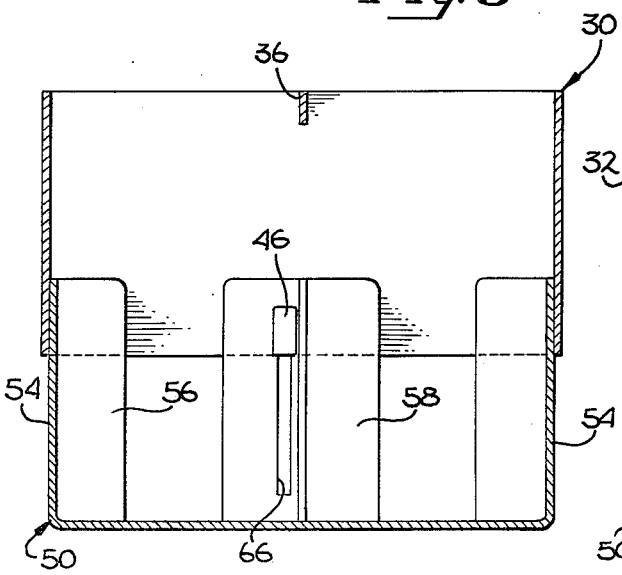
FIG. 6 is a cross-sectional view of the new bottle carrier taken along line 6—6 of FIG. 5.

With tabs 46 inserted into slots 66, the upper body member can slide upwards and downwards over the lower body member in a controlled manner. When the carrier contains bottles and is being held by the handle forming member 42, the upper body member rides up to its extended position reaching its highest point when the tabs meet the upper most boundaries of the slots, as shown in FIGS. 5 and 6. In this position, the bottles are given full lateral support and protection. Partition walls 38 and central dividing member 36, with its downwardly extending partition members 37, are in position to protect the upper part of the bottles from banging into each other during carriage of the carrier. (See FIGS. 2 and 7.) The side and end walls of the upper body member along with the side, end and corner panels of the lower body member, protect those parts of the bottles most susceptible to impact with other bodies during such carriage. When the bottle carrier is empty, the upper body member can be telescoped down over the lower body member into the contracted position. The downward movement of the upper body member is stopped when the tabs come into contact with the bottom boundaries of the slots, as can be seen in FIGS. 8 and 9.

Figure 2:
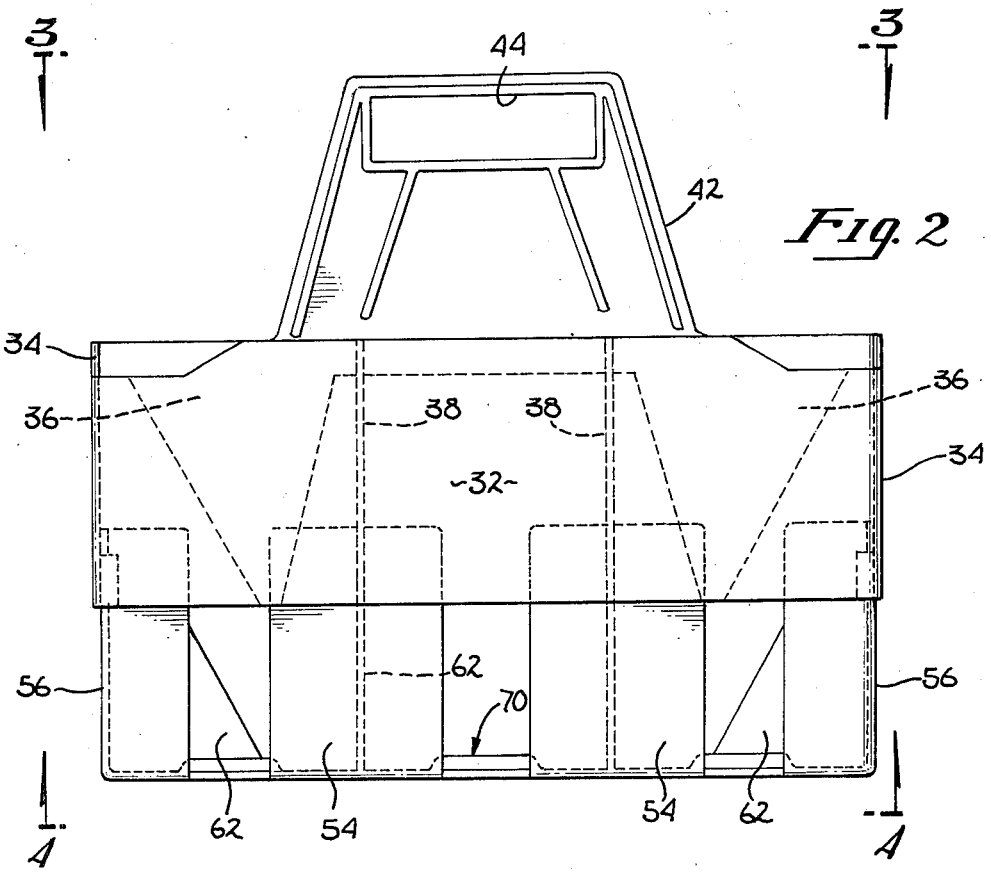
FIG. 2 is a side view of the bottle carrier shown in FIG. 1.
Figure 3:
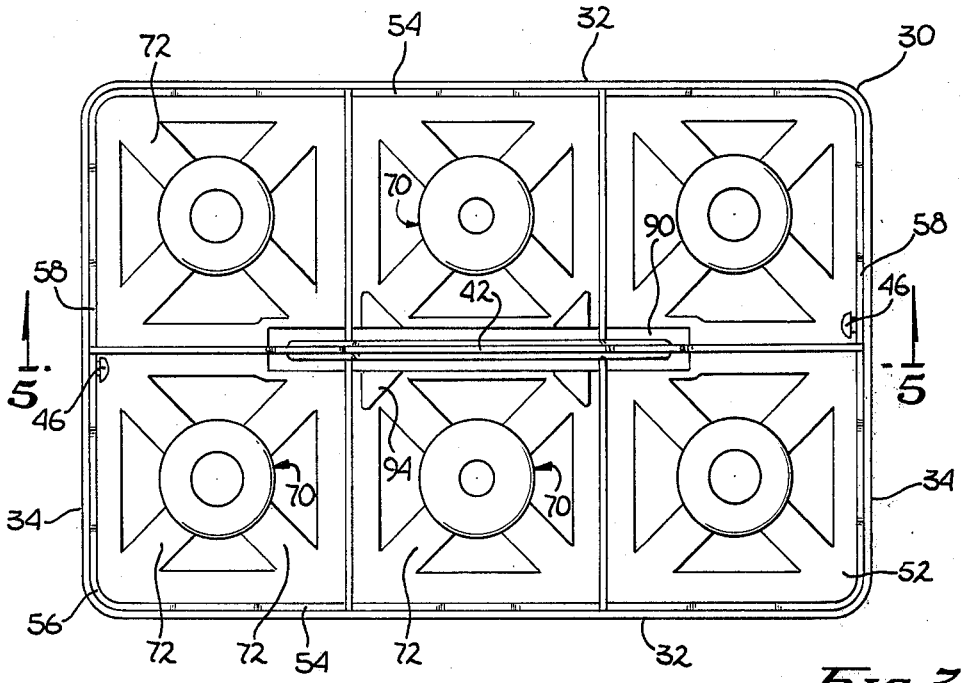
FIG. 3 is a top view of the new bottle carrier taken along the line 3—3 of FIG. 2.
Figure 7:
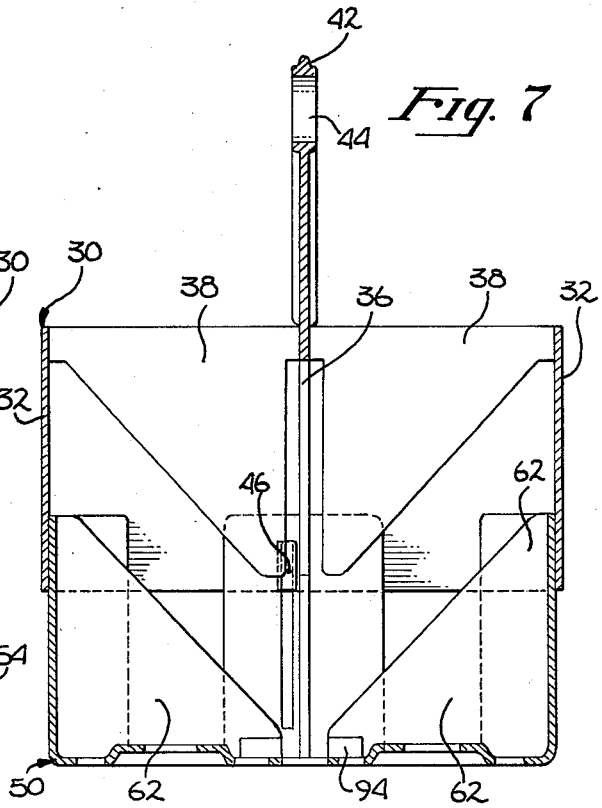
FIG. 7 is a cross-sectional view of the new bottle carrier taken along line 7—7 of FIG. 5.
Figure 8:
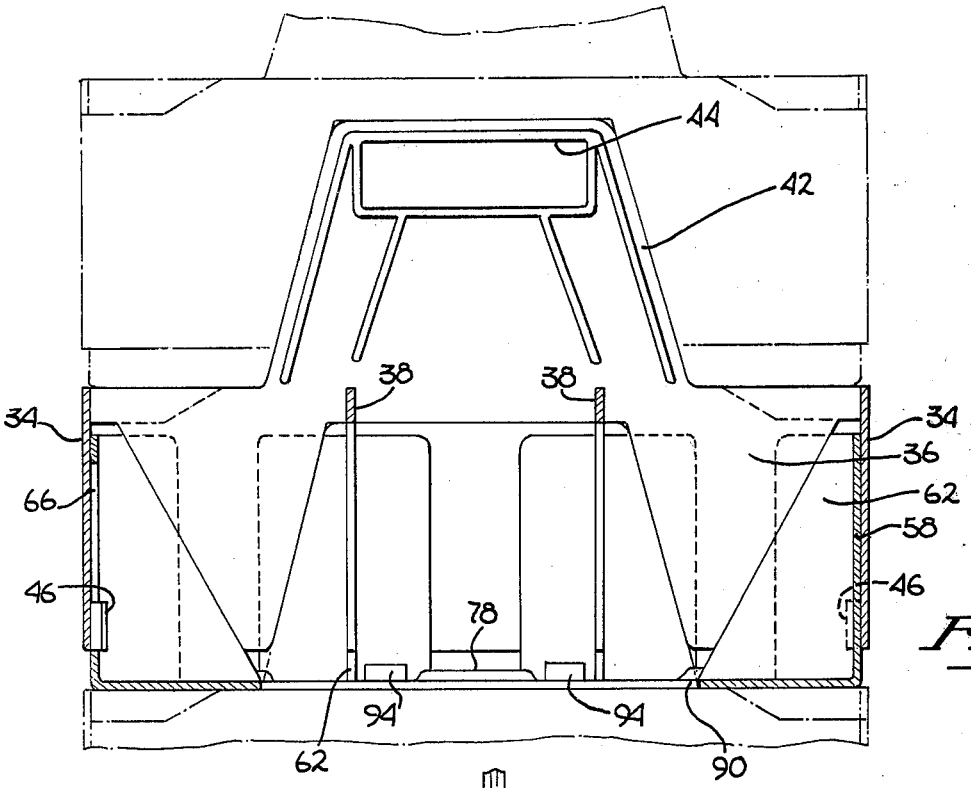
FIGS. 8 and 9 are a side and end views, taken in section, of several bottle carriers of the present invention, in contracted position, stacked one upon the other.

As can be seen in FIGS. 2 and 7, the elements of the central dividing member 36, partition walls 38 and partition panels 62 which align with each other to form the square cells for receiving bottles, are substantially separated from each other when the carrier is in the extended position. When the carrier is in the contracted position, as can be seen in FIGS. 8 and 9, these elements are in contact with each other. For this reason, these members are substantially triangular in shape. Thus, the partition wall and panel elements are slidably receivable upon each other in the contracted position and when in the extended position, provide the necessary protection for the bottles. The vertical alignment of these elements is important. If there is any misalignment, bottles may jam or break during removal and insertion of such bottles during normal bottling plant operations.

In this regard, the bottle carriers of the present invention are intended to replace standard carriers presently in use. The carriers of the present invention are of the same size and general configuration of carriers now being used and are particularly intended for use in the bottle cases now used in bottling plants. These bottle cases generally hold a plurality of bottle carriers, which in turn, hold a plurality of bottles.

Figure 4:
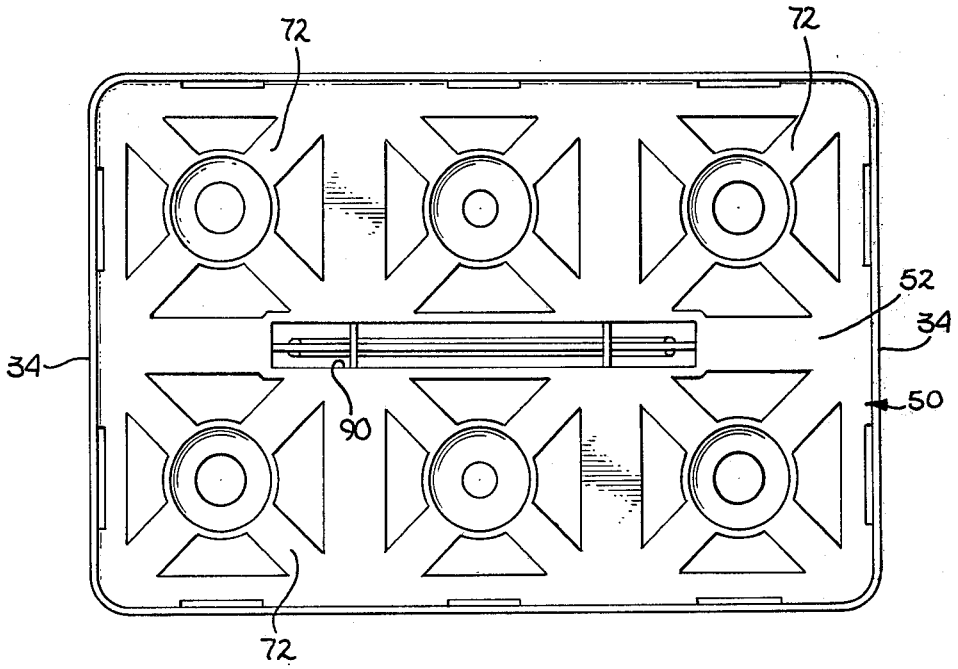
FIG. 4 is a bottom view of the new bottle carrier taken along line 4—4 of FIG. 2.

Bottom partition 52 comprises a plurality of support members 70, one for each bottle receiving cell (see FIGS. 3 and 4). The support member is located approximately centrally in the bottom of the cell. The support member is supported by arms 72, extending from the sides and corners of the cells. The arms are made in a form thin in the vertical dimension so that they are slightly bendable about a horizontal axis, allowing the bottle support member to deflect upwardly and downwardly under vertical impacts. This provides part of the cushioning for the bottles during normal bottling operations. Support members 70 are preferably made convex upwards, as shown at 78 in FIGS. 9 and 13, and shaped to be received in the downward concavity with which a bottle is normally provided. Convexity 78 serves two purposes. Firstly, it provides additional cushioning. Secondly, because the bottle will nearly always be supplied to the cell slightly off center, it serves to center the bottle in the cell.

Figure 13:
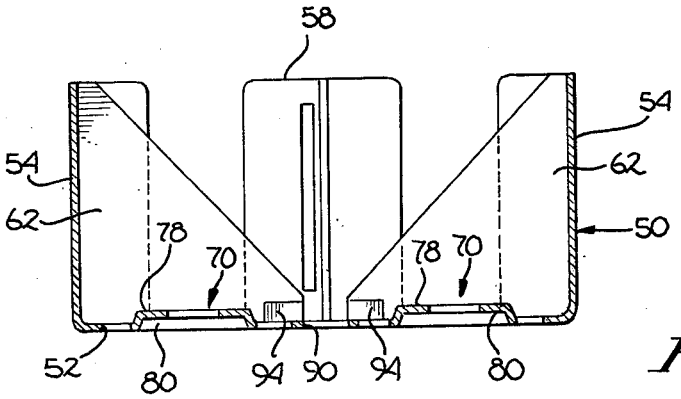
FIG. 13 is a cross-sectional view of the lower body member taken along line 13—13 of FIG. 12.

The support members are preferably made concave downwards, as shown at 80 in FIGS. 9 and 13, and shaped to receive the caps of bottles of a similar bottle carrier positioned below it when filled carriers are placed in stacked relation. This concavity assists the registration between the bottles and the carriers stacked above, and to some extent cushions the impact when a carrier filled with bottles is placed directly upon the bottles contained in another carrier.

Figure 11:
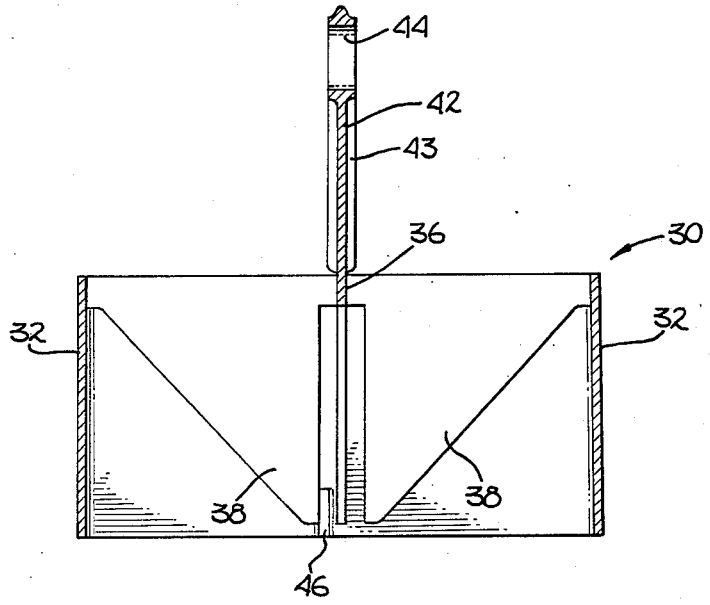
FIG. 11 is a cross-sectional view of the upper body member taken along line 11—11 of FIG. 10.
Figure 12:
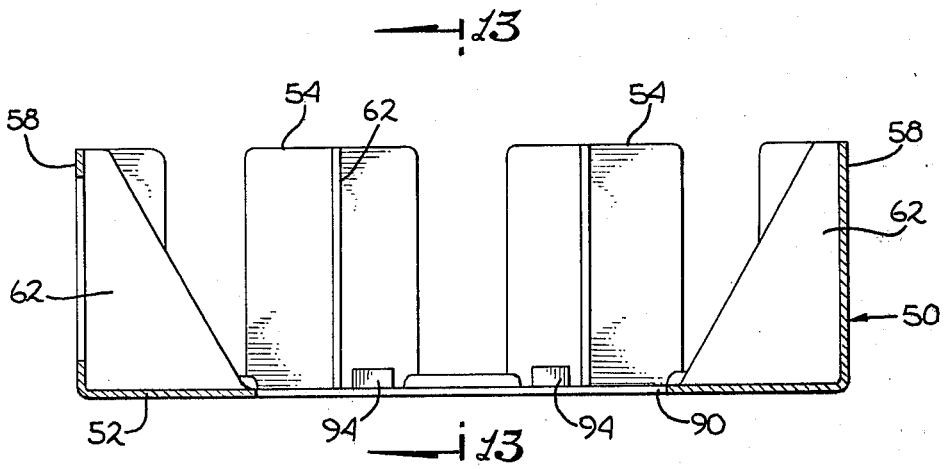
FIG. 12 is a cross-sectional side view of the lower body member of the new bottle carrier shown in FIG. 1.
Figure 15:
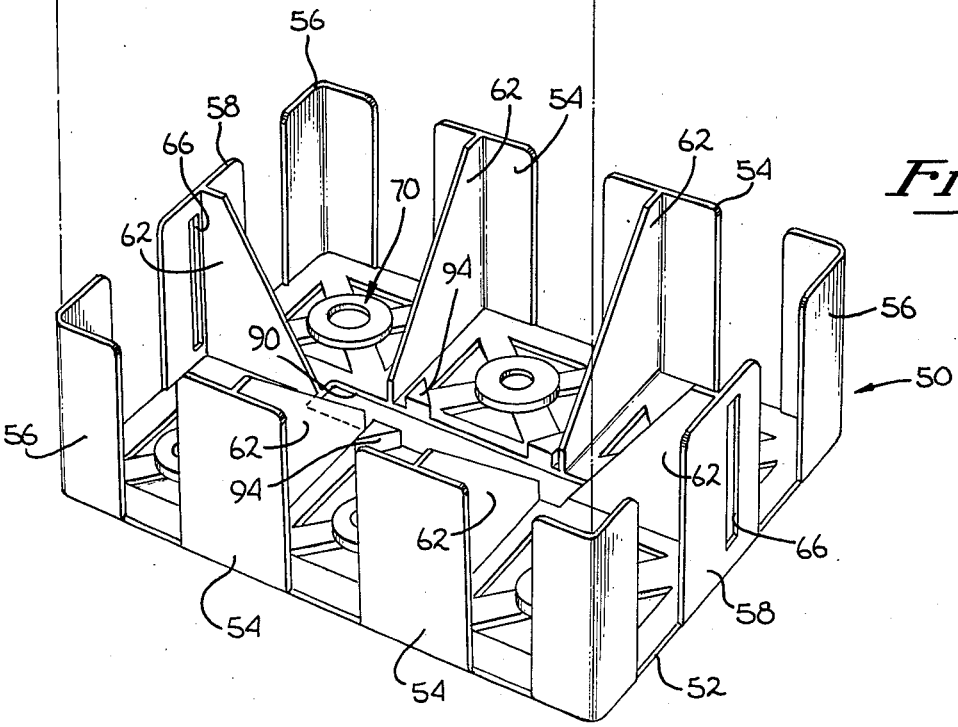
FIG. 15 is a top perspective view of the lower body member of the new bottle carrier shown in FIG. 1.

Bottle carriers of the present invention can be stacked while empty or full. As can be seen by comparing the carrier of FIG. 2, which is in the extended position, with the carrier of FIGS. 8 and 9, which is in the contracted position, carriers in the contracted position occupy significantly less vertical space than those in the extended position. Because of the great expenses incurred in shipping, handling and storing empty bottle carriers, the telescoping property of the bottle carrier of the present invention is one of the principal features of this development. Without sacrificing any vertical or lateral support or protection for the bottles to be contained therein, the present invention provides a bottle carrier which, when in stacked relation with similar empty bottle carriers, occupies about one half the space occupied by previous bottle carriers. The stacking capacity is provided to the new bottle carrier by making the horizontal length of the handle forming member 42 shorter than that of the central dividing member 36, thereby allowing provisions to be made to house the upwardly extending handle forming member in another bottle carrier of similar construction. The bottom panel 52 of lower body member 50 is provided with an opening 90, as seen in FIGS. 3 and 15, which is dimensioned to receive the handle forming member of a similar bottle carrier position below when the carriers are stacked. As shown in FIGS. 10, 11 and 14, central dividing member 36 and partition walls 38 are recessed, the recess conforming generally to the size and shape of the handle forming member 42. Thus, empty carriers can be placed in stacked relation, even when in the contracted position, because the handle forming member of one carrier can fit through the opening in the lower body member and into the recess in the upper body member of the bottle carrier positioned immediately above. It should be noted here that the reception of a handle forming member of a bottle carrier into the bottle carrier above not only provides for greater stacking density, but also provides for registration of the entire stack so that stacked carriers cannot slide laterally relative to each other. Therefore, besides great savings in space for shipping and storage, handling is made easier and therefore less expensive.

The recess put in the lower central portion of central dividing member 36 to allow stacking removes the cell wall between one or more pairs of cells (here the central pair) on opposite sides of the central dividing member. To avoid contact between the bottles in such adjoining cells across the central dividing member, cleats 94, as shown in FIGS. 3 and 15, are provided on the relevant support arms 72. This limits movement of a bottle in the relevant cell toward a bottle in the adjoining cell across the area where the portion of the central dividing member has been removed.

It is to be noted here that the lower body member could have been made with end and side walls in a similar fashion to the upper body member. Instead, end, side and corner panels were used for the purpose of saving material during manufacture of the carriers and for the purpose of cutting down on the weight. Also noted is the fact that the carriers are manufactured of strong, sturdy plastic and are capable of being safely cleaned and sterilized. Another advantage featured by this invention is that although the new bottle carrying crate disclosed herein is strong and durable and capable of long and hard use, in the event that a carrier should be in any way damaged, only the damaged body member need be discarded. Because assembly of the carrier is so easy, replacement body members may be installed at relatively little cost of handling.

The present invention is of course adaptable to satisfy various molding techniques, aesthetic requirements or other needs. For example, the upper body member can be configured as shown in FIG. 16. There the upper body member, designated by the numeral 130, has the usual side walls 32 and end walls 34. However, the central dividing member, here designated by numeral 136, is modified. It still has partition members 37, but the recess in the central dividing member extends upward to the top of the handle forming member, here designated by numeral 142. Thus, provision during molding procedures for a handle grasping aperture can be eliminated. Also, a substantial amount of material can be conserved. Ribs 43, slightly repositioned, still serve to impart strength to the handle forming member. In order to protect against contact between bottles in the cells adjoining the recessed area of the central dividing member, bearing members 194, which are flat, rectangular transverse extensions from the central most edge of partition walls 38, may be provided. These operate to limit bottle movement in a manner similar to that of the previously discussed cleat means 94.

Figure 17:
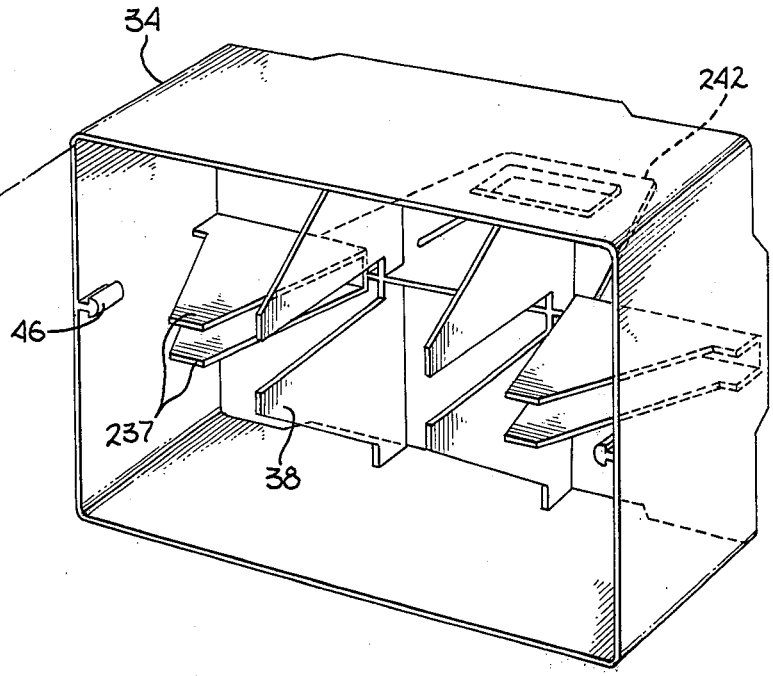
FIG. 17 is a bottom perspective view of still another embodiment of the upper body member of the bottle carrier of the present invention.
Figure 18:
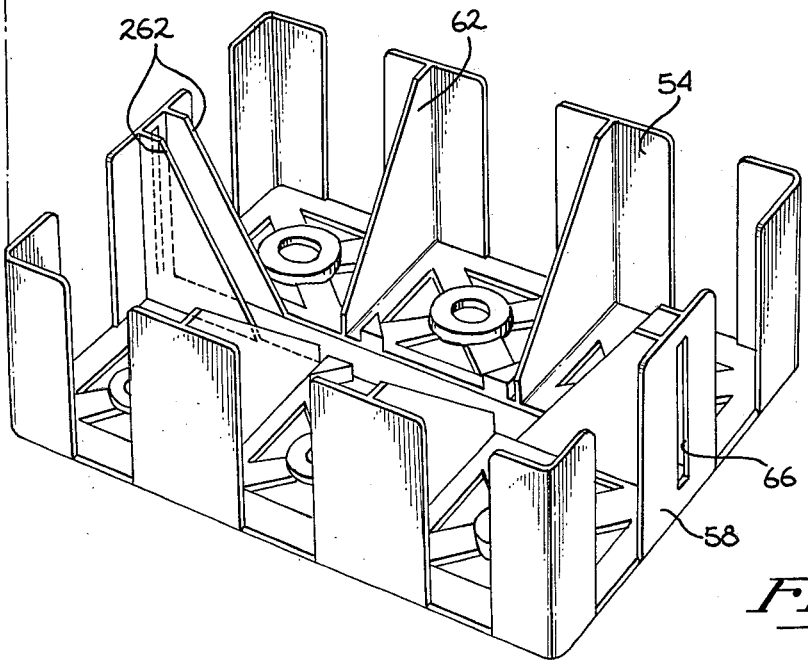
FIG. 18 is a top perspective view of an embodiment of the lower body member of the present invention intended to be used with the upper body member of FIG. 17.

FIGS. 17 and 18 illustrate another adaptation of the present invention. This embodiment allows for the incorporation of a handle forming member 242 having sides which slope in a straight line towards end walls 34. This "wide angled" handle provides additional space for advertising messages and the like. In order to accommodate this wider handle forming member when the carriers are in stacked relationship in the contracted position, opening 290 extends along the entire length of the bottom panel 252 of the lower body member. Partition panels 62 extending inward from side panels 54 remain as previously described, but the partition panels extending in from end panels 58 are doubled. These new partition panels 262 extend inwardly from end panels 58 and have their bottom edges running along the sides of opening 290 where such opening approaches the end panels. The upper body member is also modified in order to receive the wider handle forming member of a similar carrier. As shown in FIG. 17, the partition members are bifurcated to form new partition members 237. These new partition members can receive the wider handle forming members when in stacked relationship, and when the carrier is filled with bottles, they cooperate with new partition panels 262 and the other elements to form bottle receiving cells. Tabs 46 and slots 66 may be disposed slightly from the center lines of the end walls and panels as discussed previously. However, the embodiment illustrated in FIGS. 17 and 18 has slots 66 and tabs 46 centrally disposed.

FIG. 19 illustrates another embodiment of the upper body member 330. Here, in order to further save on material and simplify molding procedures, partition members are omitted from the central dividing member 336, and again the recess in the central dividing member extends to the top of the handle forming member.

As shown above, the present invention may embody many configurations. Further, while particular materials and specific details of construction have been referred to describing the carrier of the present invention, it will be understood that other materials and equivalent details of construction may be resorted to within the spirit of the invention.

I claim:

1. A bottle carrier comprised of two slidably engaged, telescoping members, the first member being comprised of a pair of facing side walls and a pair of facing end walls, the ends of said side walls attached to the adjacent ends of said end walls; a central dividing means extending from about the vertical center line of one of said end walls to about the vertical center line of the other; handle means extending upwards from said central dividing means; and partition walls cooperating with said central dividing means, said side walls and said end walls to form the upper region of a plurality of cells for receiving bottles; and the second member being comprised of a bottom panel, said bottom panel having an opening extending at least part way along the central axis which runs across its length; side and end panels extending upwards from the periphery of said bottom panel; and partition panels cooperating with said bottom, side and end panels to form the lower region of said plurality of cells for receiving bottles; said central dividing means and said opening communicating together and each being configured to receive the handle means of a similar empty bottle carrier positioned below in stacked relationship, said first and second members having cooperatively engaging means for allowing limited telescoping movement of said first and second members between a first predetermined relative position whereby said second member extends substantially below said first member to provide said plurality of cells as defined by said first and second members with a substantial height and a second predetermined relative position whereby said first and second members are substantially nested together to substantially reduce the height of said bottle carrier.

2. The bottle carrier of claim 1 wherein said side and end walls of said first member peripherally surround said side and end partitions of said second member.

3. The bottle carrier of claim 2 wherein said first member comprises tab means extending inwardly from the bottom region of said end walls, and wherein said second member has slots disposed vertically in said end panels to receive said tab means, whereby said first member is slidably engaged with said second member.

4. The bottle carrier of claim 3 wherein said tab means is substantially mushroom-shaped on cross-section to provide for easy insertion into said slots and difficult extraction therefrom.

5. The bottle carrier of claim 3 wherein said tab means disposed in one of said end walls is diagonally opposite said tab means disposed in the other of said end walls, and wherein said slots are correspondingly diagonally disposed from each other, whereby said bottle carrier is readily assemblable regardless of how many times said first and second members have been rotated relative to each other.

6. The bottle carrier of claim 1 wherein said bottom panel is comprised of a plurality of support means, each of said support means corresponding to a respective one of said cells for receiving bottles.

7. The bottle carrier of claim 1 wherein each of said support means is shaped to form an upwardly facing convexity, said convexity being shaped to at least partially enter the concavity of a bottle placed in said cell.

8. The bottle carrier of claim 1 wherein each of said support means is shaped to form a downwardly facing concavity, said concavity being shaped to at least partially receive the cap of a bottle below said carrier when filled carriers are in stacked relationship.

9. The bottle carrier of claim 1 wherein said bottom panel is provided with upwardly projecting cleat means for maintaining the separation of bottles on opposite sides of said recess in said central dividing member.

10. The bottle carrier of claim 1 wherein each of said first and said second member is of one piece molded construction.

11. A bottle carrying apparatus of generally rectangular shape in plan view, having increased stacking capacity comprising:

(a) an upper body member comprising:
- (i) means for defining end and side walls;
- (ii) dividing wall means extending longitudinally in the vertical plane between said means for defining end walls and positioned equidistantly between said means for defining side walls;
- (iii) handle means extending upwards from and in the same plane as said dividing wall means, said handle means located above said means for defining said end and side walls; and
- (iv) means for defining partition walls cooperating with said dividing wall means and said means for defining side and end walls to define a plurality of first cells;

(b) a lower body member comprising:
- (i) means for defining a bottom panel;
- (ii) means for defining end panels and means for defining side panels extending in the vertical plane upwards from the peripheral edge of said means for defining a bottom panel; and
- (iii) means for defining partition panels cooperating with said means for defining end and side panels and with said means for defining a bottom panel to form a plurality of second cells equal in number to the quantity of said first cells; and (c) engaging means for slidably engaging said upper body member with said lower body member, so that said upper body and said lower body members telescope together, wherein said upper body member may slide upwards relative to said lower body member so that said bottle carrying apparatus is in its extended position having a vertical height substantially equal to the vertical height of said lower body member plus the vertical height of said upper body member, and so that said upper body member may slide downwards relative to said lower body member so that said bottle carrying apparatus is in its contracted position having a vertical height approximately equal to the vertical height of the taller of the upper body member and the lower body member, said first cells being superimposed vertically above said second cells and cooperating therewith, thereby forming a plurality of bottle receiving cells, said means for defining a bottom panel having a centrally disposed, longitudinally extending opening, said opening and said dividing wall means being configured to receive the handle means of a similar bottle carrying apparatus when in stacked relationship.

12. The bottle carrying apparatus of claim 11 wherein said means for defining end panels has vertically extending slots and wherein said means for defining end walls has tab means extending inwardly from the bottom thereof, said tab means positioned so that they may be inserted into said slots, thereby forming said engaging means.

13. The bottle carrying apparatus of claim 11 wherein each of said upper body member and said lower body member is of one piece molded construction.

14. The bottle carrying apparatus of claim 11 wherein said dividing wall means comprises downwardly extending partition members to further define said first cells which are adjacent said means for defining end walls.

15. The bottle carrying apparatus of claim 11 wherein said handle means has an aperture therethrough to provide manual grasping means.

16. The bottle carrying apparatus of claim 11 wherein said dividing wall means comprises a recess extending upwardly from its bottom edge.

17. The bottle carrying apparatus of claim 11 wherein said opening extends the entire length of said means for defining a bottom panel.

18. The bottle carrying apparatus of claim 11 wherein said means for defining partition panels includes panel members extending inwardly from said means for defining end panels.

19. The bottle carrying apparatus of claim 11 wherein said means for defining partition panels includes paired panel members extending inwardly from said means for defining end panels, each of said pair of panel members further defining one of said second cells which are adjacent said means for defining end panels.

20. The bottle carrying apparatus of claim 11 wherein said dividing wall means comprises downwardly extending paired partition members, each of said pair of partition members further defining one of said first cells which are adjacent said means for defining end walls.

21. A bottle carrying apparatus of generally rectangular shape in plan view comprising:

(a) an upper body member having:
  1. means for defining end and side walls;
  2. handle means connected to said means for defining end walls, said handle means located above said means for defining said end walls and said side walls, and
  3. means, cooperating with said means for defining end and side walls, for defining a plurality of first cells;

(b) a lower body member comprising:
  1. means for defining a bottom panel;
  2. means for defining end panels and means for defining side panels extending in a vertical plane upward from the peripheral edge of said means for defining a bottom panel, and
  3. means, cooperating with said means for defining end and saide panels, for defining a plurality of second cells equal in number to the quantity of said first cells, and (c) engaging means for slidably engaging said upper body member with said lower body member so that said upper body and said lower body members telescope together, wherein said upper body member may slide upward relative to said lower body member so that said bottle carrying apparatus is in its extended position having a vertical height substantially equal to the vertical height of said lower body member plus the vertical height of said upper body member, and so that said upper body member may slide downward relative to said lower body member so that said bottle carrying apparatus is in its contracted position having a vertical height approximately equal to the vertical height of the taller of the upper body member and the lower body member, said first cells being superimposed vertically above said second cells and cooperating therewith, thereby forming a plurality of bottle receiving cells, said means for defining a bottom panel having a centrally disposed longitudinally extending opening, said opening being at least large enough to receive the handle means of a similar bottle carrying apparatus when in stacked relationship therewith.

22. The bottle carrying apparatus of claim 21 wherein said means for defining end panels has vertically extending slots and wherein said means for defining end walls has tab means extending inwardly from the bottom thereof, said tab means positioned so that they may be inserted into said slots, thereby forming said engaging means.

23. The bottle carrier of claim 21 wherein each of said upper body member and said lower body member is of one piece molded construction.

24. The bottle carrier of claim 21 wherein said handle means comprises a sheet member having an aperture therethrough to provide manual grasping means.

25. The bottle carrier of claim 21 wherein said opening extends the entire length of said means for defining a bottom panel.

26. The bottle carrier of claim 1, said central dividing member having a recess extending upwards from its bottom edge.

27. The bottle carrying apparatus of claim 16 wherein said recess extends upwardly through to the top edge of said handle means, thereby providing a manual grasping means.

* * * * *